US009874123B2

(12) United States Patent
Lahr

(10) Patent No.: US 9,874,123 B2
(45) Date of Patent: Jan. 23, 2018

(54) ENGINE COMPRESSION BRAKE DEVICE FOR AN INTERNAL COMBUSTION ENGINE

(71) Applicant: Daimler AG, Stuttgart (DE)

(72) Inventor: Matthias Lahr, Schwaebisch Gmuend (DE)

(73) Assignee: Daimler AG, Stuttgart (DE)

( * ) Notice: Subject to any disclaimer, the term of this patent is extended or adjusted under 35 U.S.C. 154(b) by 64 days.

(21) Appl. No.: 15/036,377

(22) PCT Filed: Oct. 25, 2014

(86) PCT No.: PCT/EP2014/002884
§ 371 (c)(1),
(2) Date: May 12, 2016

(87) PCT Pub. No.: WO2015/070949
PCT Pub. Date: May 21, 2015

(65) Prior Publication Data

US 2016/0298508 A1 Oct. 13, 2016

(30) Foreign Application Priority Data

Nov. 13, 2013 (DE) ..... 10 2013 019 000

(51) Int. Cl.
*F01L 13/06* (2006.01)
*F01L 1/053* (2006.01)
(Continued)

(52) U.S. Cl.
CPC ..... *F01L 13/06* (2013.01); *F01L 1/047* (2013.01); *F01L 1/053* (2013.01); *F01L 1/08* (2013.01);
(Continued)

(58) Field of Classification Search
CPC ... F01L 13/06; F01L 1/047; F01L 1/14; F01L 1/267; F01L 13/065; F01L 1/053;
(Continued)

(56) References Cited

U.S. PATENT DOCUMENTS 3,809,033 A * 5/1974 Cartledge ..... F01L 13/06 123/182.1
5,335,636 A * 8/1994 Bilei ..... F01L 13/06 123/321
(Continued)

FOREIGN PATENT DOCUMENTS

AU 611 323 B2 6/1991
DE 10 2007 048 915 A1 4/2009
(Continued)

OTHER PUBLICATIONS

PCT/EP2014/002894, International Search Report (PCT/ISA/210) dated Jan. 23, 2015, with partial English translation, enclosing Written Opinion of the International Searching Authority (PCT/ISA/237) (Thirteen (13) pages).
(Continued)

*Primary Examiner* — Sizo Vilakazi
(74) *Attorney, Agent, or Firm* — Crowell & Moring LLP

(57) ABSTRACT

An engine compression brake device is disclosed. The brake device has at least one camshaft which has at least one cam group with at least one firing cam and at least one brake cam, and has at least one cam follower which is functionally assigned to the firing cam and which is provided for actuating at least one gas exchange valve in a firing mode, and has a cam follower which is functionally assigned to the brake cam and which is provided for actuating at least one gas exchange valve in a braking mode. The brake device further has a switchover device which is provided for the switchover between the firing mode and the braking mode, where the switchover device is provided for converting a
(Continued)

torque of the camshaft into a force for the switchover between the firing mode and the braking mode.

8 Claims, 6 Drawing Sheets

(51) Int. Cl.

| | |
|---|---|
| ***F01L 1/08*** | (2006.01) |
| ***F01L 1/18*** | (2006.01) |
| ***F01L 1/38*** | (2006.01) |
| ***F01L 1/14*** | (2006.01) |
| *F01L 1/047* | (2006.01) |
| *F01L 13/00* | (2006.01) |

(52) U.S. Cl.
CPC ..... *F01L 1/14* (2013.01); *F01L 1/181* (2013.01); *F01L 1/38* (2013.01); *F01L 13/065* (2013.01); *F01L 2001/0476* (2013.01); *F01L 2013/0052* (2013.01)

(58) Field of Classification Search
CPC ..... F01L 1/08; F01L 1/181; F01L 1/38; F02D 13/04; F02D 9/06
See application file for complete search history.

(56) References Cited

U.S. PATENT DOCUMENTS

| | | | | |
|---|---|---|---|---|
| 6,213,091 | B1 * | 4/2001 | Haugen | F01L 1/26 123/321 |
| 2010/0288229 | A1 * | 11/2010 | Lancefield | F01L 1/047 123/321 |
| 2016/0097307 | A1 * | 4/2016 | Neukirchner | F01L 1/267 123/90.27 |

FOREIGN PATENT DOCUMENTS

| | | |
|---|---|---|
| EP | 2 191 106 B1 | 6/2010 |
| EP | 2 386 729 A1 | 11/2011 |
| WO | WO 2012/038191 | 3/2012 |

OTHER PUBLICATIONS

German Search Report issued in German counterpart application No. 10 2013 019 000.2 dated Jul. 24, 2014 (Eleven (11) pages).

* cited by examiner

ENGINE COMPRESSION BRAKE DEVICE FOR AN INTERNAL COMBUSTION ENGINE

BACKGROUND AND SUMMARY OF THE INVENTION

The invention relates to an engine compression brake device for an internal combustion engine of a motor vehicle, particularly a commercial vehicle.

An engine compression brake device is known from EP 2191106 B1, having a camshaft with at least one cam group, the same having at least one firing cam and at least one brake cam, having at least one cam follower which is functionally assigned to the firing cam and which is included for the purpose of actuating at least one gas exchange valve in firing mode, and having a cam follower which is functionally assigned to the brake cam and which is included for the purpose of actuating the at least one gas exchange valve in the braking mode, and having a switchover device which is included for the purpose of switching between the firing mode and the braking mode.

The invention particularly addresses the problem of reducing costs for an engine compression brake device and/or reducing the consumption of an internal combustion engine having such an engine compression brake device.

The invention proceeds from an engine compression brake device, having at least one camshaft with at least one cam group, the same having at least one firing cam and at least one brake cam, having at least one cam follower which is functionally assigned to the firing cam and which is included for the purpose of actuating at least one gas exchange valve in firing mode, and having a cam follower which is functionally assigned to the brake cam and which is included for the purpose of actuating the at least one gas exchange valve in braking mode, and having a switchover device which is included for the purpose of switching between the firing mode and the braking mode.

It is suggested that the switchover device is included to convert a camshaft torque into a force for switching between the firing mode and the braking mode. As a result, it is possible to utilize the torque and/or the rotational movement of the camshaft, such that there is no need for an actuator mechanism which supplies the force for the switchover, by way of example in the form of hydraulic pressure. Because the torque and/or the rotational movement of the camshaft is used for the switchover, there is no need for additional actuators which fundamentally generate an additional drag torque, such that it is possible to increase the efficiency of an internal combustion engine having such an engine compression brake device. In particular, the consumption of an internal combustion engine can be reduced as a result. However, particularly since there is no need for a corresponding actuator mechanism which directly provides force for the switchover, it is possible to reduce the number and/or complexity of actuators, thereby achieving a particularly inexpensive design. The term "cam group" is used to mean a group of cams which includes all the cams of the camshaft for a working cylinder of the internal combustion engine. The term "firing mode" is used to particularly mean a control of the gas exchange valves for combustion operation. The term "braking mode" is used to particularly mean a control of the gas exchange valves for braking operation, wherein a compression work within the working cylinder is used for the braking operation. The firing mode and the braking mode particularly differ in the activation times for the gas exchange valves. The term "switchover device" in this context is particularly used to mean a mechanism which is provided for switching between the firing mode and the braking mode. The term "provided" is particularly used to mean specially designed and/or equipped.

It is further suggested that the switchover device has at least one slotted element connected to the camshaft in a torque-proof manner which allows an axial sliding movement, the slotted element having at least one guide slot which is provided for converting a rotational movement of the camshaft into a linear switching movement of the slotted element. As a result, the rotational movement and therefore the torque of the camshaft can be easily used to switch the slotted element between two switch positions. The mechanical switching of the slotted element can then be converted into a switchover between the firing mode and the braking mode, such that it is possible to implement the switchover device with only mechanical components. An actuator required to initiate the switchover can be designed in the form of a simple electric or electromagnetic actuator.

The engine compression brake device preferably includes an actuator which is fixed in relation to the slotted element and which has at least one switch pin, which is provided to engage in the at least one guide slot and convert the rotational movement of the camshaft into the linear switching movement of the slotted element. This allows the actuator to have a simple, cost-effective design. In particular, the actuator need only be provided for the purpose of bringing the switch pin into engagement with the switching gate. The shifting force required in this case is much lower than a supporting force which is necessary when the actuator switches directly between the firing mode and the braking mode—for example, by acting directly on the cam follower. The actuator only needs to be supplied with current for the switchover between the firing mode and the braking mode. It is possible to dispense with an actuator which must be continuously active during the braking mode and/or the firing mode to maintain the switched state of the firing mode or the braking mode.

In addition, it is suggested that the switchover device has a rocker arm bearing which has a first terminal position functionally assigned to the firing mode, and a second terminal position functionally assigned to the braking mode. This allows a particularly simple mechanical design for the switchover device. Because of such a configuration, it is possible for the terminal position of the rocker arm bearing to determine whether the firing mode or the braking mode is selected, such that only the rocker arm bearing needs to be switched from one terminal position to the other terminal position to accomplish the switchover. This makes it possible to realize the switchover simply using mechanical means, without the switchover requiring an additional actuator, such that a simple and robust switchover device is required. The term "rocker arm bearing" is used to particularly mean a bearing for rocker arms used for actuating the gas exchange valves, which is designed to receive and redirect actuation forces acting on the rocker arm when the gas exchange valves are actuated.

In one particularly advantageous embodiment, the engine compression brake device has at least two rocker arms, each of which comprises one of the cam followers, which are able to pivot about a rocker arm axis determined by the rocker arm bearing for the purpose of actuating the gas exchange valve. By connecting the rocker arm to the rocker arm bearing which can be switched between the first terminal position and the second terminal position, the one rocker arm or the other rocker arm, depending on the terminal position, can have a functional connection to the camshaft, such that it is possible to easily switch between the firing mode and the braking mode.

The rocker arm bearing is preferably designed to be switched by means of the torque of the camshaft between the two terminal positions. As a result, it is possible to utilize the torque of the camshaft, thereby achieving high efficiency. Preferably, the actuating forces acting on the rocker arms when the gas exchange valves are actuated are redirected to the rocker arm bearing in such a manner that a torque is applied which can be utilized for the switching from the one terminal position to the other terminal position.

The switchover device advantageously has at least one spring-loaded detent element which is designed to fix the rocker arm bearing in the two terminal positions. This makes it possible to support the actuating forces applied to the rocker arm bearing in the firing mode and the braking mode without the need for an actuator to be continuously active. This achieves particularly high efficiency.

It is also suggested that the switchover device has at least one detent contour element mounted to allow movement, wherein the at least one detent element of the rocker arm bearing is supported against the same. Because the detent contour element is mounted to allow movement, the terminal position lock of the rocker arm bearing can be easily released. At the same time, forces which are necessary for releasing the detent element can be significantly less than forces which can be supported by the detent element for fixing the rocker arm bearing. As a result, the rocker arm bearing can be secured via the detent element against strong actuating forces, while at the same time the secured position of the rocker arm bearing can be easily released.

It is further advantageous if the detent contour element has at least two locking positions, and the slotted element is provided to pivot the at least one detent contour element from the locking positions into at least one intermediate position between the locking positions. As a result, the torque and the rotational movement of the camshaft can be utilized to release the secured position of the rocker arm bearing, whereby the complete switchover between the firing mode and the braking mode is achieved by the torque and the rotational movement of the camshaft, and the actuator of the engine compression brake device is only provided for initiating the switchover.

In addition, it is suggested that the slotted element has two switch positions, and has an actuating pin which is designed to switch the at least one detent contour element from the first locking position into the intermediate position when in the first switch position, and from the second locking position into the intermediate position when in the second switch position. In this way, the slotted element can be mechanically coupled to the detent contour element in a particularly simple manner, thereby particularly achieving a configuration in which the detent contour element is switched at a defined camshaft position, such that the complete switchover can be adapted to a cam profile of the brake cam and/or the firing cam.

The switchover device can also be in used in principle in conjunction with other valve operating mechanisms. For example, the switchover device can be designed for switching between partial load operation and full load operation, rather than for switching between a firing mode and a braking mode. It is also conceivable that the switchover device is designed for switching between a firing mode and a decompression mode, for example to increase comfort during a start and a stop of an internal combustion engine.

As a further idea of the invention, a valve operating device is therefore suggested, having at least one camshaft which comprises at least one cam group with at least one first cam and at least one second cam, having at least one cam follower functionally assigned to the first cam, which is provided for actuating at least one gas exchange valve in a first mode, and having a cam follower functionally assigned to the second cam, which is provided for actuating at least one gas exchange valve in a second mode, and having a switchover device which is provided to switch between the first mode and the second mode, wherein the switchover device is provided for the purpose of converting a torque of the camshaft into a force for switching between the first mode and the second mode. Further possible embodiments in this context particularly correspond to the dependent claims.

Additional advantages are found in the following description of the figures. The figures illustrate an embodiment of the invention. The figures, the figure description, and the claims contain numerous features in combination. A person skilled in the art will also expediently consider the features individually and combine them into additional, practical combinations.

DETAILED DESCRIPTION OF THE DRAWINGS

Figure 1:
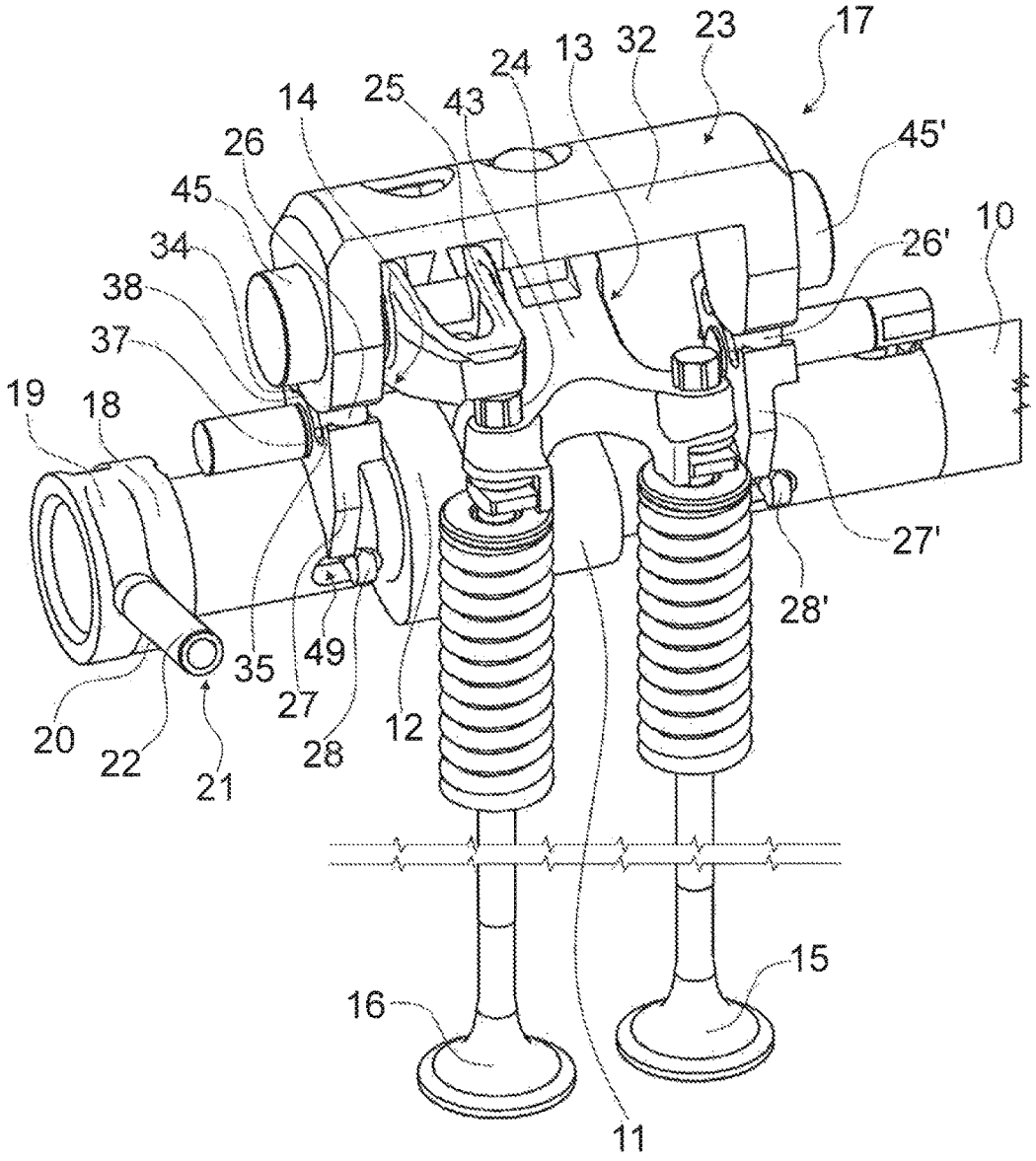
FIG. 1 shows a perspective illustration of a valve operating mechanism having an integrated engine compression brake device.

FIGS. 1 to 8 show a valve operating mechanism having an integrated engine compression brake device for an internal combustion engine of a commercial vehicle. The valve operating mechanism includes a camshaft 10 which is designed for a firing mode and an engine braking mode. The camshaft 10 is designed as the exhaust camshaft. The camshaft 10 is designed to actuate gas exchange valves 15, 16 of working cylinders, which are not illustrated in greater detail, of the internal combustion engine.

In the illustrated embodiment, the internal combustion engine comprises two gas exchange valves 15, 16 per working cylinder, which are designed as exhaust valves. The camshaft 10 comprises one cam group per working cylinder, to actuate the two gas exchange valves 15, 16. Only one of the cam groups is illustrated in the embodiment. Other cam groups which are not illustrated, designed to actuate the gas exchange valves of further working cylinders, have an analogous design.

The cam group comprises a firing cam 11 which is designed to open the gas exchange valves 15, 16 in a firing mode, and a brake cam 12 which is designed to open one of the gas exchange valves 15, 16 in a braking mode. The firing cam 11 and the brake cam 12 have different cam profiles. The cam profile of the firing cam 11 has an elevation 11' which is particularly designed to open the gas exchange valves 15, 16 while a piston in the corresponding working cylinder is moved from a bottom dead center to a top dead center to expel gas from the working cylinder. The cam profile of the brake cam 12 is essentially designed to open the gas exchange valve 16 after the piston in the corresponding working cylinder has been moved from the bottom dead center to the top dead center, in order to leave air and/or combustion air compressed in the process unused. The cam profile of the brake cam 12 of the engine compression brake device according to the invention, shown in FIGS. 1 to 8, has three elevations 12', 12', 12'''. In FIGS. 5 to 8, the three elevations 12', 12'', 12''' of the brake cam 12 are clearly visible. The elevation 12' forms a first decompression and/or brake elevation. The elevation 12'' forms a second decompression and/or brake elevation. The elevation 12''' forms an after-charging elevation. The engine compression brake device illustrated in FIGS. 1 to 8 is therefore designed as 2-stroke engine compression brake with after-charging. Of course, the engine compression brake device can be designed as a 4-stroke engine compression brake with only one braking elevation 12' and one optional after-charging elevation 12''. No further details are given here on the functionality and action of braking and after-charging cams, since they are well known from the prior art.

For the actuation of the gas exchange valves 15, 16, the valve operating mechanism with the integrated engine compression brake device comprises a cam follower 13, which is provided for the firing mode, and a cam follower 14 which is provided for the braking mode. The cam follower 13, which is provided for the firing mode, is only provided for a functional connection to the firing cam 11. The cam follower 14, which is provided for the braking mode, is only provided for a functional connection with the brake cam 12.

For switching between the firing mode and the braking mode, the engine compression brake device has a switchover device 17, which is provided to switch between an actuation of both gas exchange valves 15, 16 by the firing cam 11 and an actuation of the single gas exchange valve 16 by the brake cam 12 (see FIG. 1). The switchover device 17 in this case is designed to switch back and forth between the firing cam 11 profile being tapped by the cam follower 13 functionally assigned to the same, and the brake cam 12 profile being tapped by the cam follower 14 functionally assigned to the same. The switchover device 17 is only provided for switching the actuation of the gas exchange valves 15, 16 of the one working cylinder. For the further working cylinders, the engine compression brake device can fundamentally have further, analogously designed switchover devices which can be at least partially coupled to each other.

The valve operating mechanism has two rocker arms 24, 25 which are functionally assigned to the cam group. The one rocker arm 24 is provided for the firing mode and has the cam follower 13, which is provided for the functional connection to the firing cam 11. The other rocker arm 25 is provided for the braking mode, and has the cam follower 14, which is provided for the functional connection to the brake cam 12. The rocker arm 24 provided for the firing mode acts on both gas exchange valves 15, 16. The rocker arm 25 provided for the braking mode only acts on the one gas exchange valve 16 in the illustrated embodiment, but can act in principle on both gas exchange valves 15, 16. In the embodiment illustrated in FIGS. 1 to 8, in the braking mode the rocker arm 25 acts on the gas exchange valve 16 via an adjusting element 43 which is mounted in the rocker arm 24 in a manner allowing longitudinal sliding. The movements of the two rocker arms 24, 25 are independent. Depending on whether the firing mode or the braking mode is selected, the camshaft 10 actuates the corresponding rocker arm 24, 25, while the other rocker arm 24, 25 is decoupled from the camshaft 10.

The switching device 17 is provided to convert a torque of the camshaft 10 into a force for switching between the firing mode and the braking mode. For the control provided by means of a control and regulating device, which is not shown, the switchover device 17 has an electromagnetic actuator 21, which is not shown, by means of which the switchover can be initiated. Including the actuator 21, which is provided only for the purpose of triggering the switchover, the switchover device 17 is completely mechanical.

The switchover device 17 has a slotted element 18 which is connected to the camshaft 10 in a torque-proof manner which allows an axial sliding movement. The slotted element 18 has a first guide slot 19 which is provided for the switchover from the firing mode to the braking mode, and has a second guide slot 20 which is provided for the switchover from the braking mode to the firing mode. The guide slots 19, 20 are offset with respect to each other on the slotted element 18 by a corresponding angle. Each of the guide slots 19, 20 has an angular extension which corresponds to its function. The guide slots 19, 20 in this case each have a capturing segment, a switching segment, and a disengagement segment, which are not designated in the figures. Each of the capturing elements oriented along the periphery has an increasing guide slot depth. The switching segments, which have a substantially constant guide slot depth, have an axial component. The disengaging segments each have a decreasing guide slot depth.

The switch segments of the guide slots 19, 20 are particularly provided to convert a rotary motion of the camshaft 10 into a shifting movement of the guide slot 18, the movement occurring axially relative to an axis of rotation 29 of the camshaft 10. The switching movements which can be initiated by means of the guide slots 19, 20 are oriented in this case in opposite directions. That is, the one guide slot 19 is provided to switch the slotted element 18 in the first direction, while the second guide slot 20 is provided to switch the slotted element 18 in the opposite second direction. The slotted element 18 has two discrete switch positions between which it can be switched by means of the guide slots 19, 20. In the embodiment shown, a switching movement initiated by the guide slot 19 leads to a switchover from the firing mode to the braking mode, and accordingly a switching movement initiated by the guide slot 20 leads to a switchover from the braking mode to the firing mode.

The actuator 21, which is provided to initiate the switchover, is arranged to be stationary relative to the slotted element 18, which is arranged rotatably by the camshaft 10. The valve operating mechanism has a housing 44, shown in FIG. 2, to which the actuator 21 is fixed. The actuator 21 comprises a switch pin 22, which when extended engages in the respective guide slot 19, 20 of the slotted element 18. In order to initiate the switchover, the switch pin 22 is extended. Next, the switch pin 22 is brought into engagement with the associated guide slot 19, 20 via the corresponding capturing segment. Upon a further rotational movement of the camshaft 10, the slotted element 18 is pushed by the switching segment, wherein axial forces are generated for the switchover from the torque acting on the camshaft 10, and are supported via the switch pin 22. Subsequently, the switch pin 22 is retracted again by the disengagement segment. A switchover in the two directions proceeds analogously. The switch pin 22 in this case is provided to retract, after disengaging from the one guide slot 19, 20, into the other guide slot 20, 19 during a subsequent switchover.

For switching the functional connection between the camshaft 10 and the cam followers 13, 14, the switchover device 17 has a rocker arm bearing 23 which has a first terminal position functionally assigned to the firing mode and a second terminal position functionally assigned to the braking mode. The rocker arm bearing 23 is used in particular for mounting the rocker arms 24, 25, and determines a rocker arm axis 30 for the rocker arm 24, and a rocker arm axis 31 for the rocker arm 25, wherein the respective rocker arms 24, 25 are mounted to allow pivoting about the respective axes (FIGS. 5 to 8).

Figure 4:
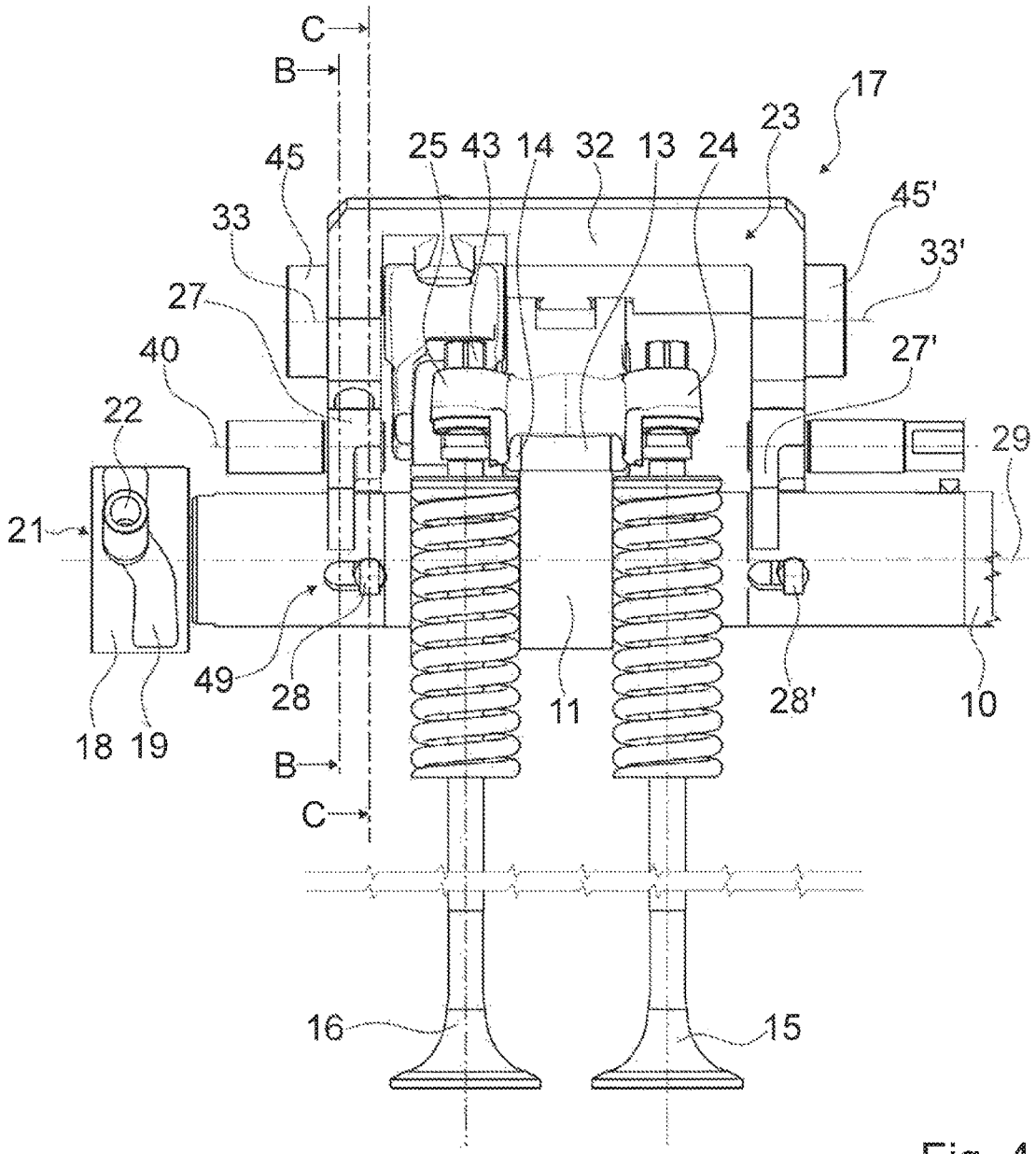
FIG. 4 shows the valve operating mechanism in a side view.
Figure 5:
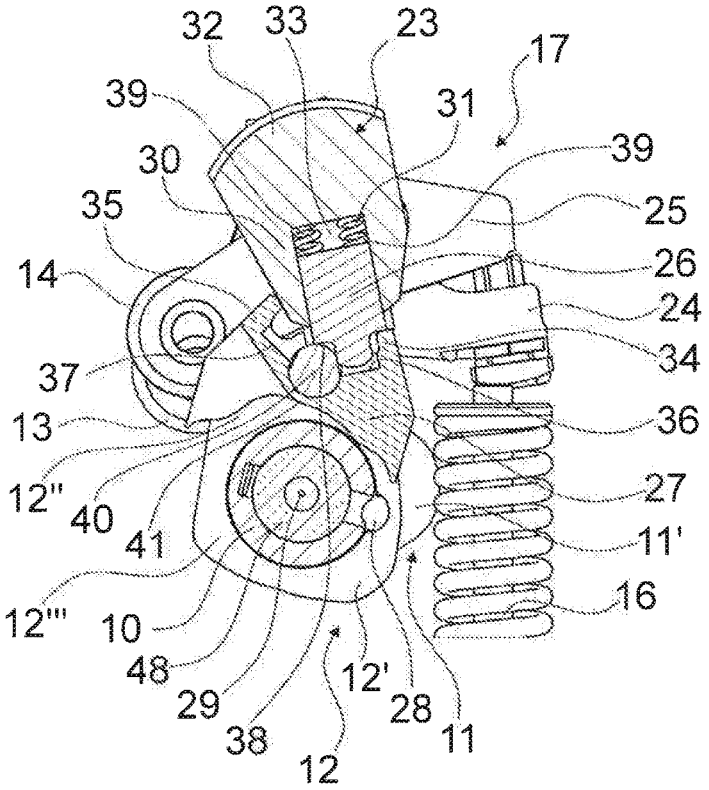
FIG. 5 shows a cross-section of the valve operating mechanism cut in the plane B-B in FIG. 4, in a switch position for a firing mode.
Figure 6:
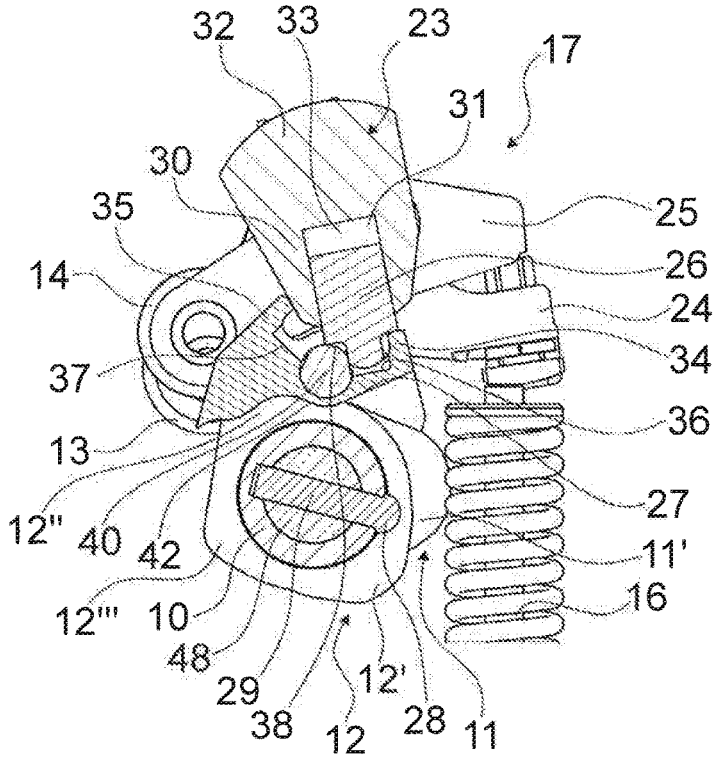
FIG. 6 shows a cross-section of the valve operating mechanism cut in the plane C-C in FIG. 4, in a switch position for the firing mode.

The rocker arm bearing 23 comprises a mounting element 32 on which the rocker arms 24, 25 are mounted (see FIGS. 1 and 4). The mounting element 32 itself is pivotably mounted. A mounting axis 33 about which the mounting element 32 is able to pivot is arranged parallel to the rocker arm axes 30, 31. The mounting element 32 is supported against the housing 44 of the valve operating mechanism.

The mounting element 32 is designed in the form of a U-shaped bracket, wherein ends 45, 45' of the mounting element 32 which are oriented parallel to the rotational axis 29 of the camshaft 10 serve the purpose of mounting about the mounting axis 33, and wherein the rocker arms 24, 25 are attached to a portion of the mounting element 32 which runs substantially parallel to the camshaft 10 (see FIG. 4). The ends 45, 45' of the mounting element 32 are held in a manner allowing rotation in bearings 47, 47' of the housing 44. The camshaft is held in a manner allowing rotation in bearings 46 of the housing 44.

Figure 2:
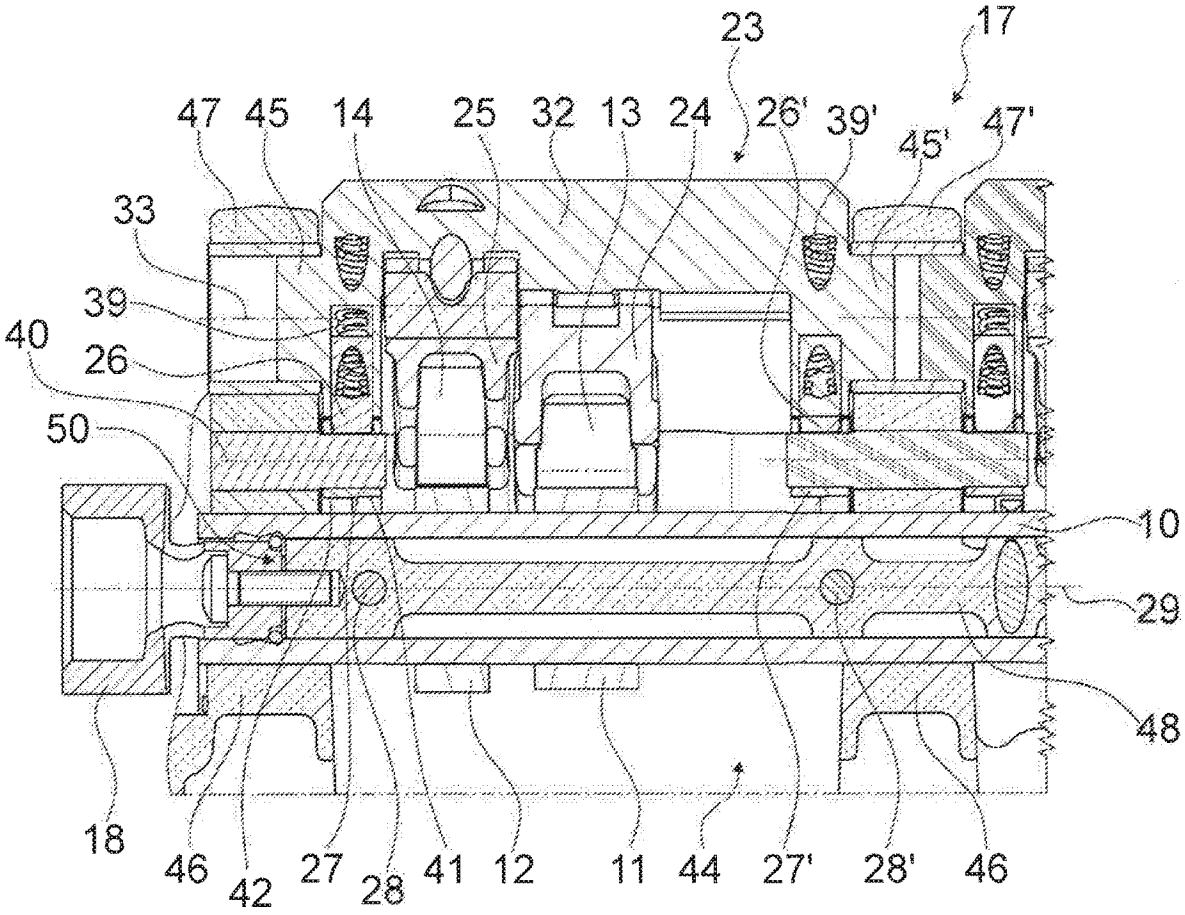
FIG. 2 shows the valve operating mechanism in a frontal view.
Figure 3:
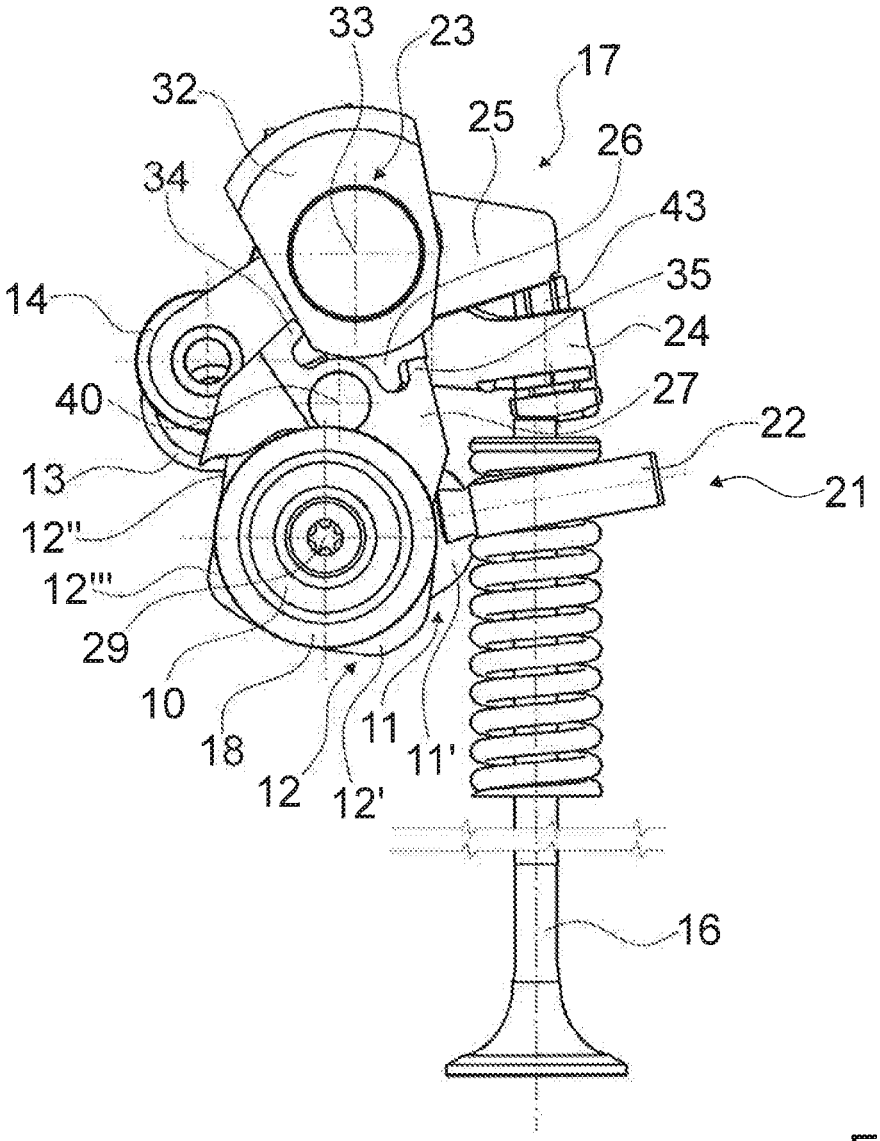
FIG. 3 shows the valve operating mechanism in cross-section.
Figure 7:
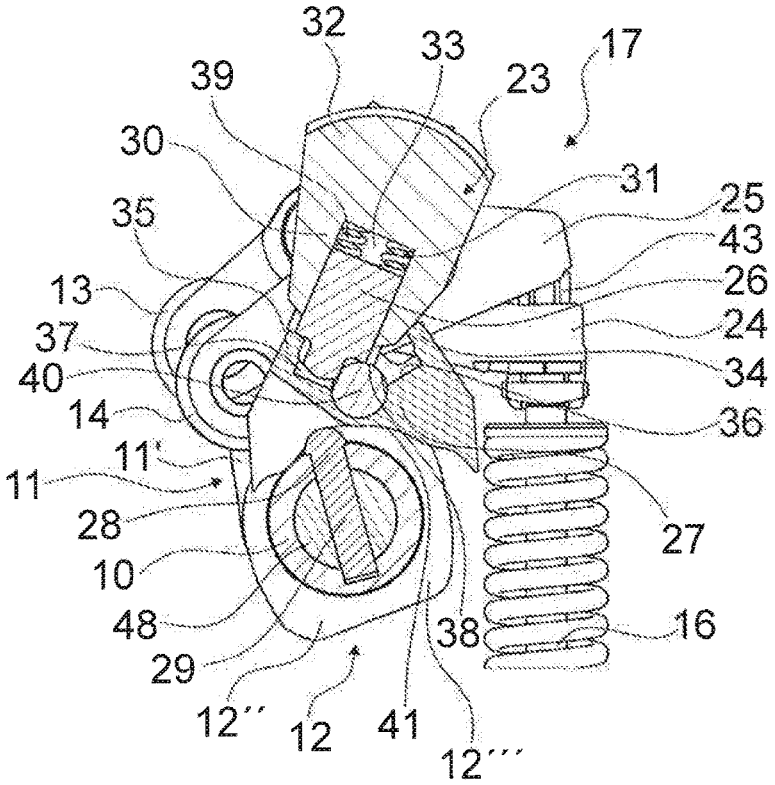
FIG. 7 shows a cross-section of the valve operating mechanism cut in the plane B-B in FIG. 4, in a switch position for a braking mode.
Figure 8:
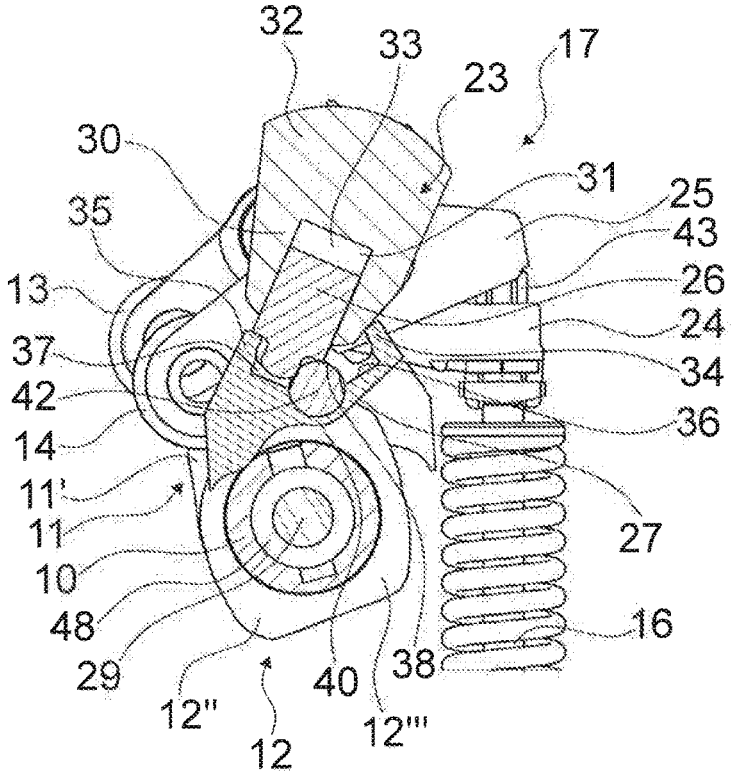
FIG. 8 shows a cross-section of the valve operating mechanism cut in the plane C-C in FIG. 4, in a switch position for the braking mode.

The mounting axis 33 of the mounting element 32 is oriented parallel and offset with respect to the axis of rotation 29 of the camshaft 10 (see FIG. 2). In the first terminal position, the cam follower 13 provided for the firing mode is in constant contact with the firing cam 11. However, the cam follower provided for the braking mode is lifted away from the brake cam 12, such that the brake cam 12 passes underneath the cam follower 14 with no effect (FIGS. 1 to 6). In the second terminal position, in which the opposite is true, the cam follower 14 provided for the braking mode is in constant contact with the brake cam 12, while the cam follower 13 provided for the firing mode is lifted away from the firing cam 11, such that the firing cam 11 passes underneath the cam follower 13 with no effect (FIGS. 7 and 8).

The rocker arm bearing 23 is provided in this case to be switched by means of the rotational movement of the camshaft 10. If the mounting element 32 is switched into the first terminal position, a force is applied by the firing cam 11 to the mounting element 32 when the gas exchange valves 15, 16 are activated which is fundamentally oriented towards the second terminal position (FIGS. 1 to 6). If the mounting element 32 is switched into the second terminal position, a force is applied by the brake cam 12 to the mounting element 32 when the gas exchange valve 16 is activated which is fundamentally oriented towards the first terminal position (FIGS. 7 and 8).

The force acting on the mounting element 32, which is utilized for the switchover between the two terminal positions, results from an actuation force which is exerted on the gas exchange valves 15, 16 in the firing mode and in the braking mode by means of the camshaft 10. The mounting element 32 supports this actuating force. Because the two rocker arm axes 30, 31 about which the rocker arms 24, 25 are mounted to pivot relative to the mounting element 32 are offset from each other, a different force is applied to the mounting element 32 depending on which of the rocker arms 24, 25 is used to actuate the gas exchange valves 15, 16. The mounting axis 33 of the mounting element 32 in this case is operatively arranged between the two rocker arm axes 30, 31. If a rocker arm 24 is actuated, a torque results from the actuating force of this rocker arm 24 which is applied to the mounting element 32, and which is oriented in the opposite direction, with respect to the mounting axis 33 of the mounting element 32, of the torque which results from the actuating force of the other rocker arm 25, which is applied to the mounting element 32 when the other rocker arm 25 is actuated. Because the actuating force in each case results from the torque of the camshaft 10, and the torque acting on the mounting element 32 in turn results from the actuating force, the rocker arm bearing 23 is switched by means of the rotational movement of the camshaft 10.

To fix the rocker arm bearing 23, the switching device 17 has a spring-loaded detent element 26 which is provided to fix the rocker arm bearing 23 in the two terminal positions. The detent element 26 is mounted to allow axial movement relative to the mounting element 32. The switchover device 17 has a spring element 39 which is interposed between the mounting element 32 and the detent element 26.

For a functional connection to the detent element 26, the switchover device 17 comprises a detent contour element 27, against which the detent element 26 is supported. For a positive connection to the detent element 26, the detent contour element 27 has a detent contour with two depressions 36, 37 lying between two stops 34, 35. An elevation 38 is situated between the two depressions 36, 37. The first depression 36, which is assigned to the first terminal position in the firing mode, is located between the first stop 34 and the elevation 38. The second depression 37, which is assigned to the second terminal position in the braking mode, is located between the second stop 35 and the elevation 38. The depressions 36, 37 define two locking positions in which the detent element 26 and the detent contour element 27 are connected to each other by a positive fit.

A pivot movement of the mounting element 32 is limited by the two mechanical stops 34, 35, which define the two terminal positions of the rocker arm bearing 23. When the mounting element 32 executes a pivot movement from the second terminal position in the braking mode into the first terminal position in the firing mode, the stops 34, 35 limit the pivot movement of the mounting element 32 by the stop 35 resting on the mounting element 32 and the stop 34 resting on the detent element 26. Accordingly, the stops 34, 35 limit the pivot movement of the mounting element 32 out of the first terminal position in the firing mode and into the second terminal position in the braking mode by the stop 34 now resting on the mounting element 32 and the stop 35 now resting on the detent element 26. The detent element 26 is connected with a motion mechanism to the mounting element 32. Upon a movement of the mounting element 32 from the one terminal position into the other terminal position, the detent element 26 moves from the one depression 36, 37 past the elevation 38 and into the other depression 36, 37. In the terminal positions, the detent element 26 and the detent contour element 27 fix the mounting element 32 against the torque which is applied during the actuation of the gas exchange valves 15, 16. A spring force which is provided by the spring element 39 supported between the detent element 26 and the mounting element 32 is great enough in this case to support the torque resulting from the actuating force of the gas exchange valves 15, 16 on the elevation 38, such that the detent element 26 does not change from one depression 36, 37 into the other depression 36, 37.

In order to release the detent element 26 from one of its locking positions, the detent contour element 27 is mounted to allow movement. The detent contour element 27 has a bearing shaft 40 which lies in the region of the elevation 38 of the detent contour. In the illustrated embodiment, the mounting axis 40 forms the elevation 38 for the detent contour element 27 between the two depressions 36, 37. That is, the detent contour is partially formed by the bearing shaft 40. If the mounting element 32 moves from the one terminal position into the other terminal position, a virtual center line of the detent element 26 pivots past the bearing shaft 40 of the detent contour element 27. The bearing shaft 40 then lies between the two depressions 37, 37, which define terminal positions of the rocker arm bearing 23.

The movably mounted detent contour element 27 is able to pivot between the first locking position, which is assigned to the firing mode (FIGS. 1 to 6), and the second locking position, which is assigned to the braking mode (FIGS. 7 and 8). In the first locking position of the detent contour element 27, the mounting element 32 in its first terminal position is in the firing mode, wherein the detent element 26 engages in the first depression 36 of the detent contour. In the second locking position of the detent contour element 27, the mounting element 32 in its second terminal position is in the braking mode, wherein the detent element 26 engages in the second depression 37 of the detent contour. In the locking positions, one of the depressions 36, 37 of the detent contour element 27 forms a global minimum for the detent element 26, in which the detent element 26 is guided when the actuating force for the gas exchange valves 15, 16 is supported via the mounting element 32 against the camshaft 10.

Depending on which of the locking positions the detent contour element 27 is switched into, the mounting element 32 for the rocker arms 24, 25 is switched into the terminal position corresponding to the locking position when the gas exchange valves 15, 16 are next actuated. The switchover between the firing mode and the braking mode results from the detent contour element 27 being pivoted from the one locking position into the other locking position.

The slotted element 18 is provided for the purpose of pivoting the detent contour element 27 from the locking positions into an intermediate position between the locking positions. The slotted element 18 and the detent contour element 27 are mechanically coupled to each other. The slotted element 18 which projects from the camshaft 10 is connected to a switch rod 48 accommodated in the camshaft 10 in a manner allowing axial sliding. The slotted element 18 and the switch rod 48 slide together axially when the switch pin 22 engages in one of the guide slots 19, 20 along the axis of rotation 29 of the camshaft 10. An actuating pin 28 is housed in the switch rod 48, which projects through a longitudinal slot 49 out of the camshaft 10. The actuating pin 28 therefore also slides along the rotation axis 29 with the axial sliding of the switch rod 48 in its longitudinal slot 49. The actuating pin 28 is provided to transmit the torque acting on the camshaft 10 to the detent contour element 27, and to pivot the detent contour element 27 by means of the torque. The slotted element 18 connected to the switch rod 48 has a suitable latch device 50 with the camshaft 10, such that a corresponding position of the switch rod 48 in the camshaft 10 can be held for the braking mode or firing mode.

The detent contour element 27 is arranged physically between the detent element 26 and the camshaft 10. It has a side which faces the detent element 26, which forms the detent contour. In addition, it has a side which faces the camshaft 10, which forms an actuation contour for the pivoting by means of the torque of the camshaft 10. The actuating contour has two tracks 41, 42 which are offset from each other along the rotational axis 29 of the camshaft 10. Depending on which switch position the slotted element 18 is switched into, the actuating pin 28 engages in the one track 41 of the actuating contour or in the other track 42 of the actuating contour. The length of the path which the slotted element 18 can travel axially corresponds to a distance between the tracks 41, 42 comprised by the actuating contour of the detent contour element 27.

In relation to the rotational movement of the actuating pin 28 about the axis of rotation 29 of the camshaft 10, the tracks 41, 42 are designed as inclined tracks. The actuation contour of the detent contour element 27 is provided to translate the torque of the camshaft 10 applied to the actuating pin 28 into a torque applied to the detent contour element 27 to pivot the detent contour element 27 about its bearing shaft 40. The actuating pin 28 in its functional connection with the actuating contour of the detent contour element 27 is provided to switch the detent contour element 27 from the first locking position of the firing mode into the intermediate position in the first switch position of the slotted element 18. For this purpose, the switch pin 22 engages into the guide slot 19 and the actuating pin 28 is moved from the track 41 to the track 42. In the second switching position of the slotted element 18, the detent contour element 27 switches from the second locking position of the braking mode into the intermediate position. For this purpose, the switch pin 22 engages in the guide slot 20 and the actuating pin 28 is moved from the track 42 to the track 41. The actuating pin 28 is therefore in each case only provided to switch the detent contour element 27 into the intermediate position.

The intermediate position is designed in the illustrated embodiment as a center position between the two locking positions. If the detent contour element 27 pivots into the center position, the detent element 26 moves in the detent contour. The detent element 26 moves in this case inside the detent contour of the corresponding depression 36, 37 onto the elevation 38. Then the detent element 26 is guided out of the intermediate position and into the other locking position when the actuating force on the gas exchange valves 15, 16, which results from the rotation and the torque of the camshaft 10, is supported on the camshaft 10 during the next actuation of the gas exchange valves 15, 16 via the mounting element 32.

The switchover between the firing mode and the braking mode is thus carried out in two steps. In the first step, the torque and the rotational movement of the camshaft 10 are transmitted via the slotted element 18, the detent contour element 27 and the detent element 26 to the mounting element 32, and cause the detent element 26 to move from the corresponding locking position into the intermediate position. In the second step, the torque and the rotational movement of the camshaft 10 are transmitted via the corresponding rocker arms 24, 25, and cause the detent element 26 to move from the intermediate position into the corresponding locking position.

In the illustrated embodiment, the switchover device 17 comprises a second detent element 26' and a detent contour element 27', which are likewise switched by means of the slotted element 18. The slotted element 18 has for this purpose a second actuating pin 28', and spring elements 39' which are provided for a functional connection to the second detent contour element 27'. The two detent contour elements 27, 27' act in parallel.

The invention claimed is:

1. An engine compression brake device, comprising:

a camshaft which has a cam group with a firing cam and a brake cam;

a first cam follower which is functionally assigned to the firing cam and which actuates at least one gas exchange valve in a firing mode;

a second cam follower which is functionally assigned to the brake cam and which actuates at least one gas exchange valve in a braking mode; and a switchover device which switches over between the firing mode and the braking mode;

wherein the switchover device converts a torque of the camshaft into a force for switchover between the firing mode and the braking mode, wherein the switchover device has a rocker arm bearing which has a first terminal position functionally assigned to the firing mode and a second terminal position functionally assigned to the braking mode, and wherein the rocker arm bearing is switchable by the torque of the camshaft between the first terminal position and the second terminal position.

2. The engine compression brake device according to claim 1, wherein the switchover device has a slotted element connected to the camshaft in a torque-proof manner which allows for an axial sliding movement and wherein the slotted element has at least one guide slot which converts a rotational movement of the camshaft into a linear switching movement of the slotted element.

3. The engine compression brake device according to claim 2, wherein an actuator is fixed in relation to the slotted element and has a switch pin which engages in the at least one guide slot and converts the rotational movement of the camshaft into the linear switching movement of the slotted element.

4. The engine compression brake device according to claim 1, wherein a first rocker arm is associated with the first cam follower and a second rocker arm is associated with the second cam follower and wherein the first and second rocker arms are pivotable about respective rocker arm axes of the rocker arm bearing.

5. The engine compression brake device according to claim 1, wherein the switchover device has a spring-loaded detent element which fixes the rocker arm bearing in the first terminal position and the second terminal position.

6. The engine compression brake device according to claim 5, wherein the switchover device has a detent contour element and wherein the spring-loaded detent element is supported against the detent contour element.

7. The engine compression brake device according to claim 6, wherein the detent contour element has a first locking position and a second locking position and wherein a slotted element of the switchover device pivots the detent contour element from the first and second locking positions into an intermediate position between the first and second locking positions.

8. The engine compression brake device according to claim 7, wherein the slotted element has a first switch position and a second switch position and has an actuating pin which switches the detent contour element from the first locking position into the intermediate position when in the first switch position and from the second locking position into the intermediate position when in the second switch position.

* * * * *